US008348173B2

(12) United States Patent
Shin

(10) Patent No.: US 8,348,173 B2
(45) Date of Patent: Jan. 8, 2013

(54) PORTABLE TEMPERATURE CONTROLLED CONTAINER

(75) Inventor: In Jae Shin, Seoul (KR)

(73) Assignee: ROYAL BIJOU, Seoul (KR)

( * ) Notice: Subject to any disclaimer, the term of this patent is extended or adjusted under 35 U.S.C. 154(b) by 0 days.

(21) Appl. No.: 13/009,714

(22) Filed: Jan. 19, 2011

(65) Prior Publication Data

US 2011/0226444 A1 Sep. 22, 2011

Related U.S. Application Data

(63) Continuation of application No. 11/949,683, filed on Dec. 3, 2007, now abandoned.

(60) Provisional application No. 60/868,302, filed on Dec. 18, 2006.

(51) Int. Cl.
*G05D 23/12* (2006.01)
*F25D 3/08* (2006.01)

(52) U.S. Cl. ..... 236/1 C; 62/457.1; 62/457.9; 62/452; 220/592.01; 220/592.14; 220/592.15

(58) Field of Classification Search ..... 236/1 C; 62/457.1, 457.9, 463, 452, 454; 220/592.01, 220/592.14, 592.15
See application file for complete search history.

(56) References Cited

U.S. PATENT DOCUMENTS

| | | | | |
|---|---|---|---|---|
| 3,593,888 | A | 7/1971 | Brown | |
| 4,802,344 | A * | 2/1989 | Livingston et al. | 62/372 |
| 5,048,724 | A | 9/1991 | Thomas | |
| 5,096,092 | A * | 3/1992 | Devine | 222/95 |
| 6,098,849 | A | 8/2000 | McInnes | |
| 6,609,392 | B1 * | 8/2003 | Brown | 62/457.1 |
| 6,763,665 | B2 * | 7/2004 | Clark et al. | 62/3.6 |
| 6,820,765 | B2 * | 11/2004 | Pahl | 222/95 |
| 2006/0218963 | A1 | 10/2006 | Elias | |

FOREIGN PATENT DOCUMENTS

| | | | |
|---|---|---|---|
| JP | 1158077 | A | 6/1989 |
| JP | 1158077 | A2 | 6/1989 |
| JP | 08210746 | A2 | 8/1996 |

* cited by examiner

*Primary Examiner* — Marc Norman
(74) *Attorney, Agent, or Firm* — Arent Fox LLP

(57) ABSTRACT

A portable temperature controlled container having a body including an internal chamber with an opening into the internal chamber; and a temperature control unit coupled to the body and displaced to be thermally coupled with a first portion of the internal chamber, the temperature control unit configured to selectively alter the temperature in the internal chamber by releasing a thermally controlled material into the internal chamber.

11 Claims, 17 Drawing Sheets

PORTABLE TEMPERATURE CONTROLLED CONTAINER

CLAIM OF PRIORITY UNDER 35 U.S.C. §119.

The present Application for Patent claims priority to Provisional Application Ser. No. 60/868,302, entitled "PORTABLE COOLING SYSTEM," filed Dec. 2, 2006, and expressly incorporated herein by reference.

BACKGROUND

1. Field

The present invention relates generally to temperature controlled containers, and more particularly, to a portable temperature controlled container.

2. Background

In many portable food vending applications, the use of a portable temperature controlled container is necessary for keeping the product to be dispensed at a particular temperature. For example, in vending applications involving the dispensing of a frozen dessert such as the "soft-serve" variety of soft ice cream, it would be preferable if the ice cream is kept at a temperature that is within a specific range of temperatures. If the ice cream is not kept cold enough, then it will melt. Conversely, if the ice cream is kept at a temperature that is too low, then the ice cream may be too hard to dispense. In other examples, it is desirable that liquids such as beer are cooled and maintained around a certain temperature. It may also be preferable that the food or liquid to be dispensed is to be kept at a temperature that is higher than the ambient temperature. For example, a roaming vendor at a baseball stadium may desire to sell hot dogs at a temperature that is higher than the ambient temperature. In another example, the foods to be dispensed may be a liquid such as hot chocolate or soup.

Adding to the challenge of maintaining food at a particular temperature, in many cases the type of food to be dispensed will often need to be kept at a temperature that is on ah opposite end of the temperature spectrum from the ambient temperature. Thus, on a cold day, hot or warm foods and liquids are desirable. In contrast, on a warm day, cold or frozen foods and liquids are desirable.

Typically, the foods or liquids to be dispensed are carried by a vendor in an insulated container, with the temperature of the interior of the container being maintained around a particular temperature through the use of a source of cooling or heating. For example, cooling may come from a coolant, such as an ice or dry ice (i.e., frozen carbon dioxide) pack, that is much colder than the item to be cooled. As such, it is a challenge to maintain the temperature of the item to be cooled around the desired range if the item is a food product that needs to be cooled, but not frozen, because the coolant is much colder than the food product needs to be. Thus, it would be preferable if the container were able to maintain the temperature of the items contained therein within a specific range even though the source of cooling is at a temperature that is much lower than the desired temperature. Further, the approach used to cool the contents of the container needs to be compatible with the portability aspect of the application. This eliminates such solutions as refrigeration units due to the weight of these units and the amount of energy they need to operate, even though refrigeration units are capable of being turned off and on to control the amount of cold that is generated.

It may also be preferable that the food to be stored in the container is kept at a temperature that is higher than the ambient temperature. The heat source may be a heat pack that generates heat using a chemical reaction or an electrically powered heater. However, similar to the cooling application, the heat source is typically at a higher temperature than the food needs to be. Thus, it would also be preferable if the system were able to maintain the temperature of the items contained therein within a specific range even though the source of heating is at a temperature that is much higher than the desired temperature.

There is therefore a need in the art for a solution to provide a temperature controlled container that is portable and can dispense food easily.

SUMMARY

Aspects disclosed herein address the need to provide a temperature controlled container that is portable by providing a portable temperature controlled container having a body including an internal chamber with an opening into the internal chamber; and a temperature control unit coupled to the body and displaced to be thermally coupled with a first portion of the internal chamber, the temperature control unit configured to selectively alter the temperature in the internal chamber by releasing a thermally controlled material into the internal chamber.

DRAWINGS

The invention may be more readily understood by referring to the accompanying drawings in which.

Like numerals refer to like parts throughout the several views of the drawings.

DETAILED DESCRIPTION

Various aspects of the disclosure are described below. It should be apparent that the teachings herein may be embodied in a wide variety of forms and that any specific structure, function, or both being disclosed herein is merely representative. Based on the teachings herein, one skilled in the art should appreciate that an aspect disclosed herein may be implemented independently of any other aspects and that two or more of these aspects may be combined in various ways. For example, an apparatus may be implemented or a method may be practiced using any number of the aspects set forth herein. In addition, such an apparatus may be implemented or such a method may be practiced using other structure, functionality, or structure and functionality in addition to or other than one or more of the aspects set forth herein. Furthermore, an aspect may comprise at least one element of a claim.

The word "exemplary" is used herein to mean "serving as an example, instance, or illustration." Any aspect described herein as "exemplary" is not necessarily to be construed as preferred or advantageous over other aspects.

Figure 1:
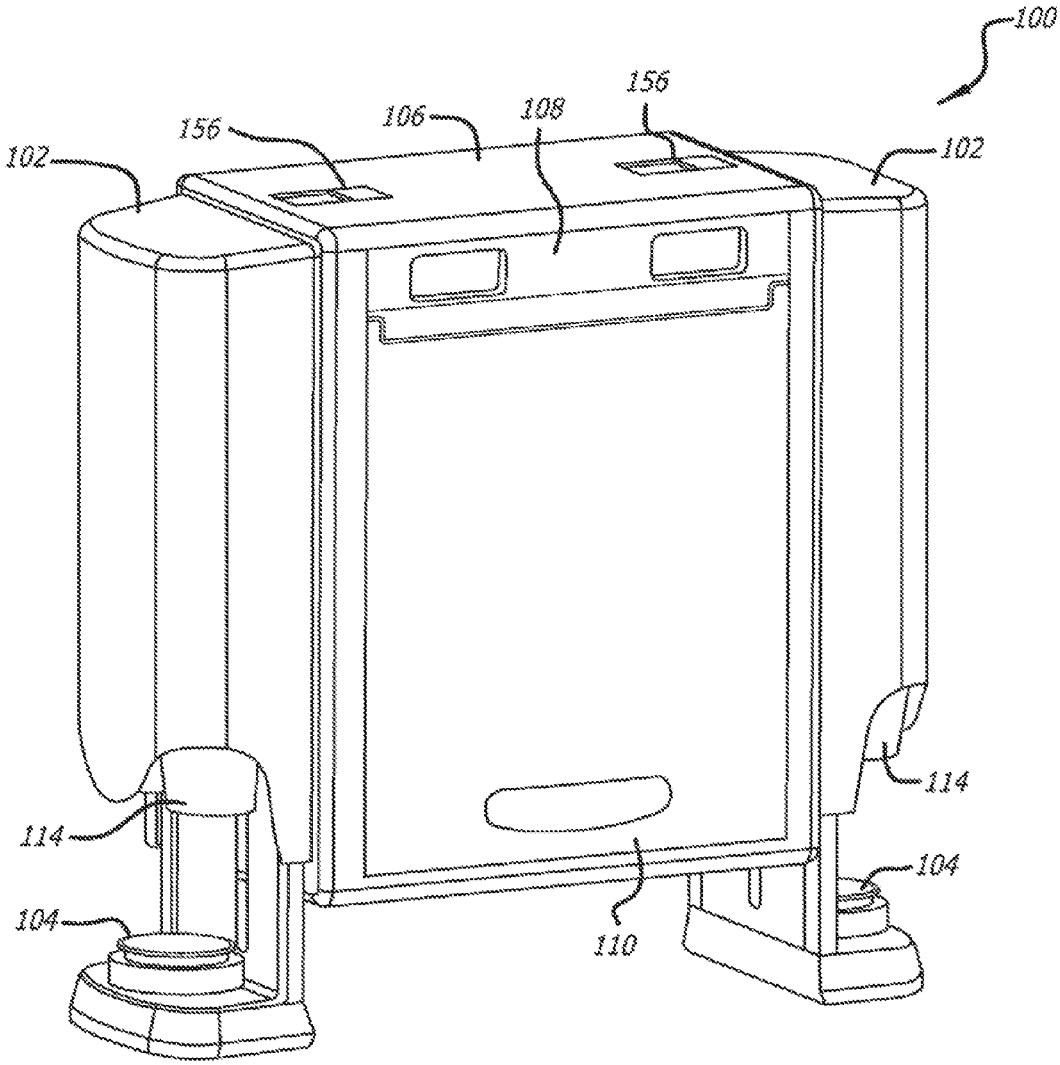
FIG. 1 is a front perspective view of a frozen food dispenser.

The various aspects of the disclosure will first be explained in an application where a frozen dessert is to be dispensed. FIG. 1 illustrates a frozen food dispenser 100 configured in accordance with a disclosed aspect of the portable temperature controlled container. The frozen food dispenser 100 includes a pair of cup dispensers 102 and a pair of cup holders 104. Each cup dispenser of the pair of cup dispensers 102 in an aspect of the disclosed frozen food dispenser holds two sets of cups 114 into which the frozen food is to be dispensed. In another aspect, other containers may be used, including edible containers. For example, the pair of cup dispensers 102 may dispense edible ice cream cones. The frozen food dispenser 100 includes a top door 106 through which a pair of codling chambers is accessed, as further described herein. The top door 106 includes a pair of top door latches 156 to secure the top door 106 to the body of the frozen food dispenser 100. The frozen food dispenser 100 also includes an instrument panel 108 for a user to interface with the frozen food dispenser 100, arid a front door 110 through which a pair of internal chambers of the frozen food dispenser 100 is accessed.

Figure 2:
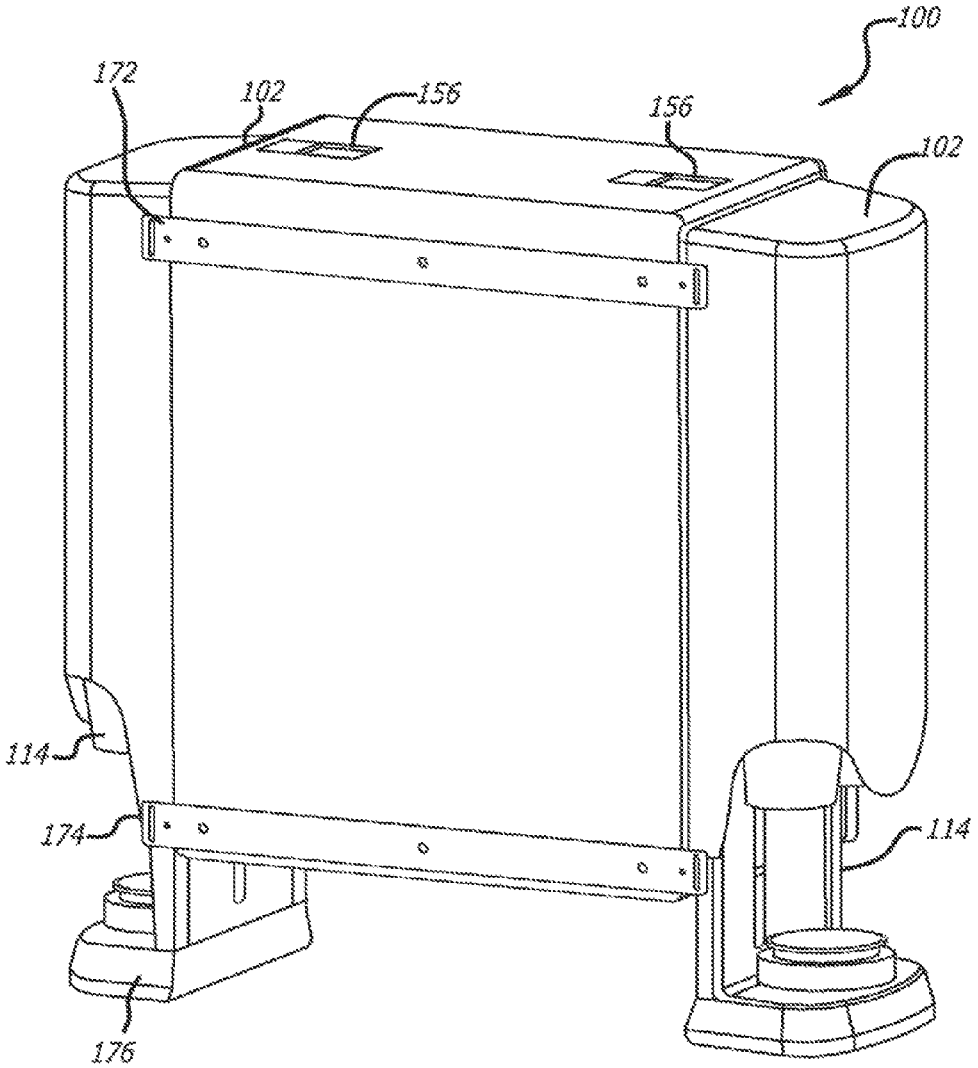
FIG. 2 is a rear perspective view of the frozen food dispenser of FIG. 1.

FIG. 2 is a rear perspective view of the frozen food dispenser 100 illustrating a back panel 176 and attachment points 172 and 174 for a harness (not shown). In one aspect, the user wears the harness, with the frozen food dispenser 100 being located in from of the user. The frozen food dispenser 100 may use insulation technology to thermally separate the user from the contents of the frozen food dispenser 100. The use of insulation is also desirable to maximize the cooling that has been applied to the contents of the frozen food dispenser 100.

Figure 3:
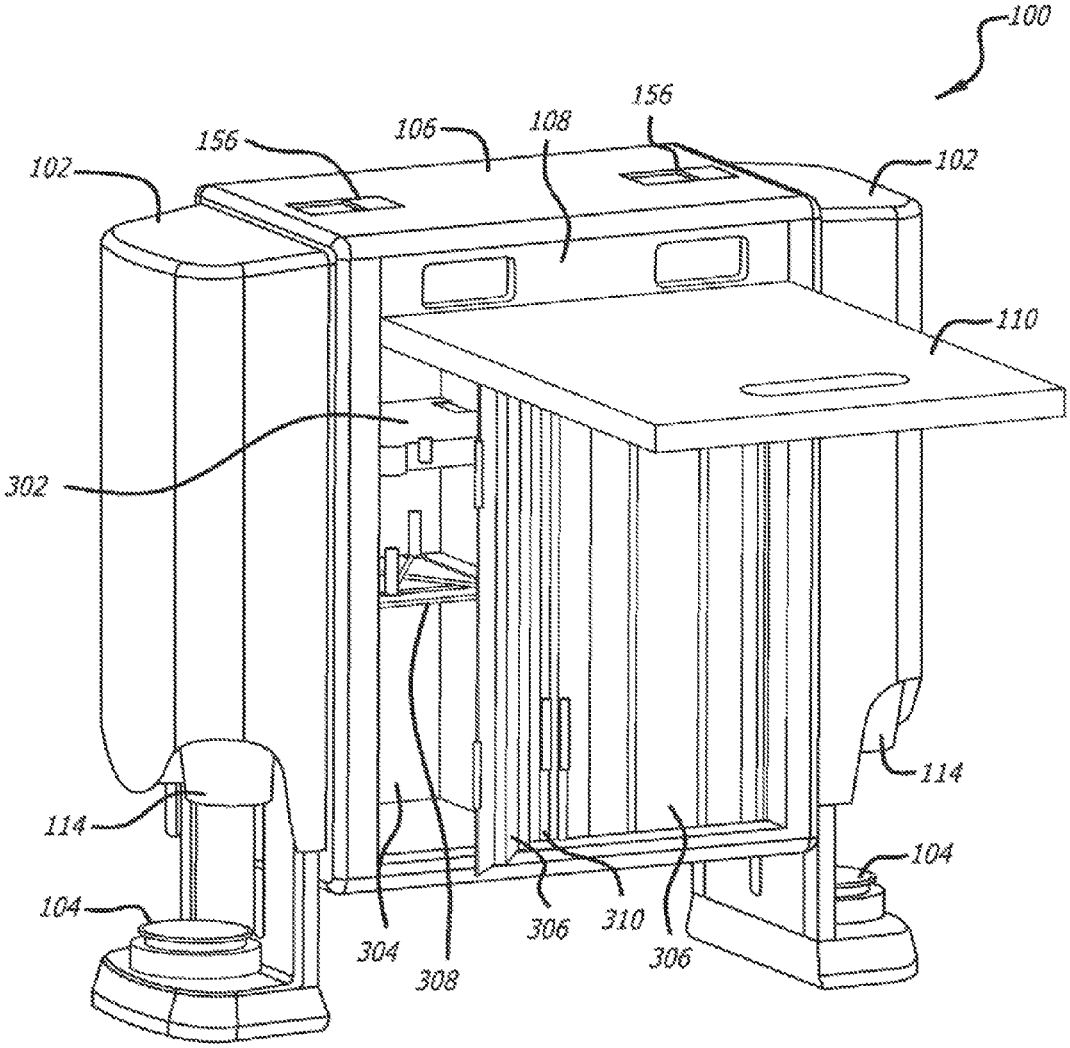
FIG. 3 is a front perspective view of the frozen food dispenser of FIG. 1 with a open front door exposing an internal chamber.

FIG. 3 illustrates the frozen food dispenser 100 with the front door 110 being opened to expose an interior chamber that houses a temperature control and compressor assembly 310. The temperature control and compressor assembly 310 includes a pair of inner doors 306 used to access a pair of respective internal chambers 304 of the temperature control and compressor assembly 310. Each internal chamber of the pair of internal chambers 304 has a particular volume in which a container or other object may be inserted. Insulation may also be used on each internal chamber to thermally separate them. The temperature control and compressor assembly 310 includes a volume control system configured to change the volume of each internal chamber of the pair of internal chambers 304, as well as a temperature control system configured to control the temperature of the internal chamber 304, as further described herein.

In an aspect of the disclosed temperature control and compressor assembly, the volume control system of the temperature control and compressor assembly 310 includes an elevator assembly 302 and a pressure plate 308 for each internal chamber of the pair of internal chambers 304. The elevator assembly 302 and the pressure plate 308 are illustrated in FIG. 3 as being apart from each other. However, in operation of the temperature control and compressor assembly 310, the elevator assembly 302 will be moved to engage the pressure plate 308. The elevator assembly 302 may also be mechanically attached to the pressure plate 308 so that the elevator assembly 302 and the pressure plate 308 move together.

Figure 8:
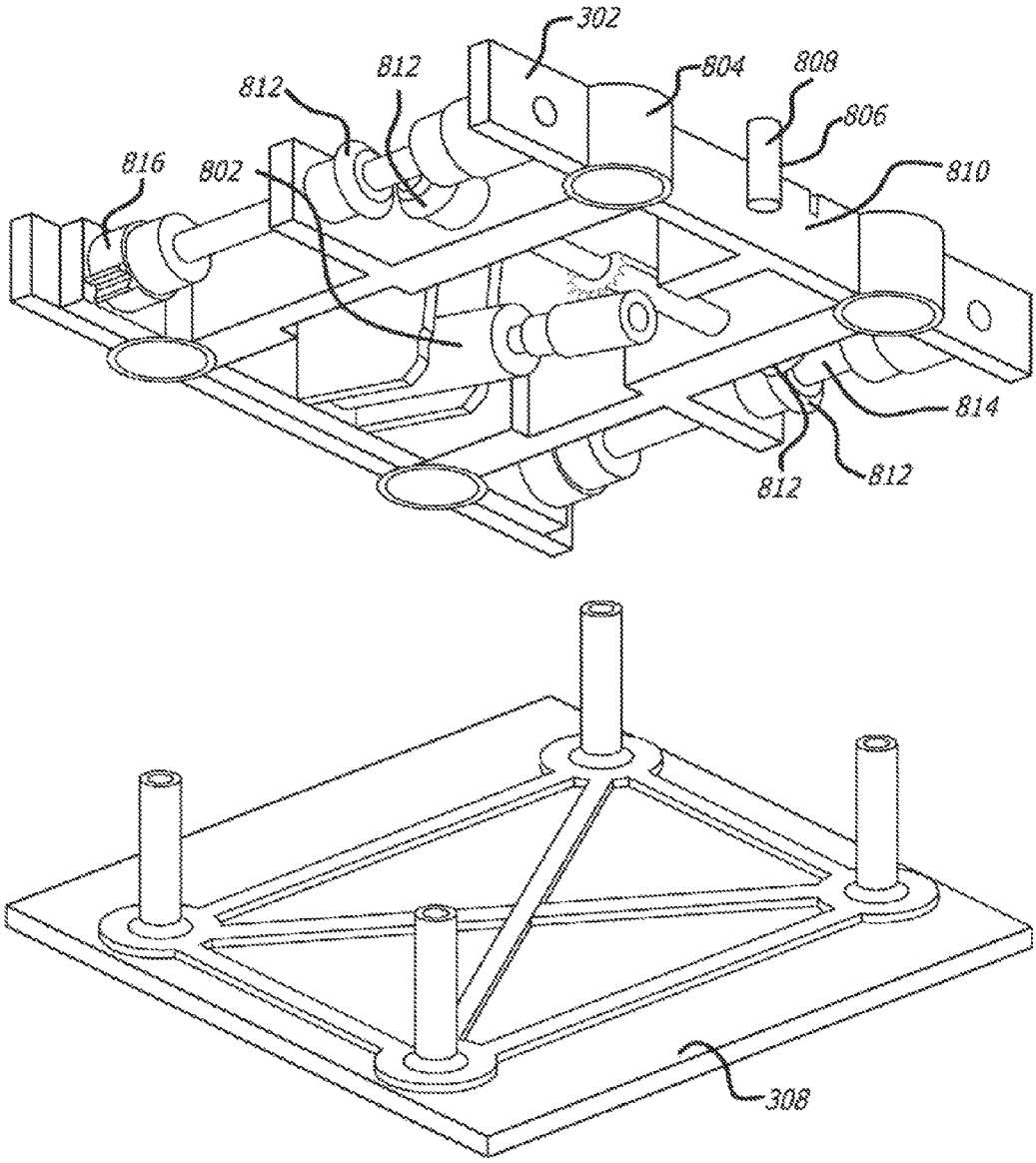
FIG. 8 is a perspective view of an elevator assembly of the temperature control and compressor assembly of FIG. 4.

FIG. 8 is a perspective view of the elevator assembly 302 of the temperature control and compressor assembly 310 of FIG. 3 configured in accordance with an aspect of the disclosed temperature control and compressor assembly. The elevator assembly 302 includes a motor 802 mounted in an elevator frame 804 that drives a worm gear 810. The worm gear 810 is attached to a shaft 808 to drive a second shaft 814 through a plurality of bevel gears 812. The second shaft 814 includes a plurality of drive gears 816 that are engaged with the plurality of tracks 440 to compress the frozen food container 900. Specifically, as the motor 802 is operated, the plurality of drive gears 816 may be driven to move the elevator assembly 302 up or down. As noted, in an aspect of the disclosed compression assembly, the elevator assembly 302 is coupled to the pressure plate 308 so that when the elevator assembly 302 is driven up or down, the pressure plate 308 is also moved up or down, respectively.

Figure 4:
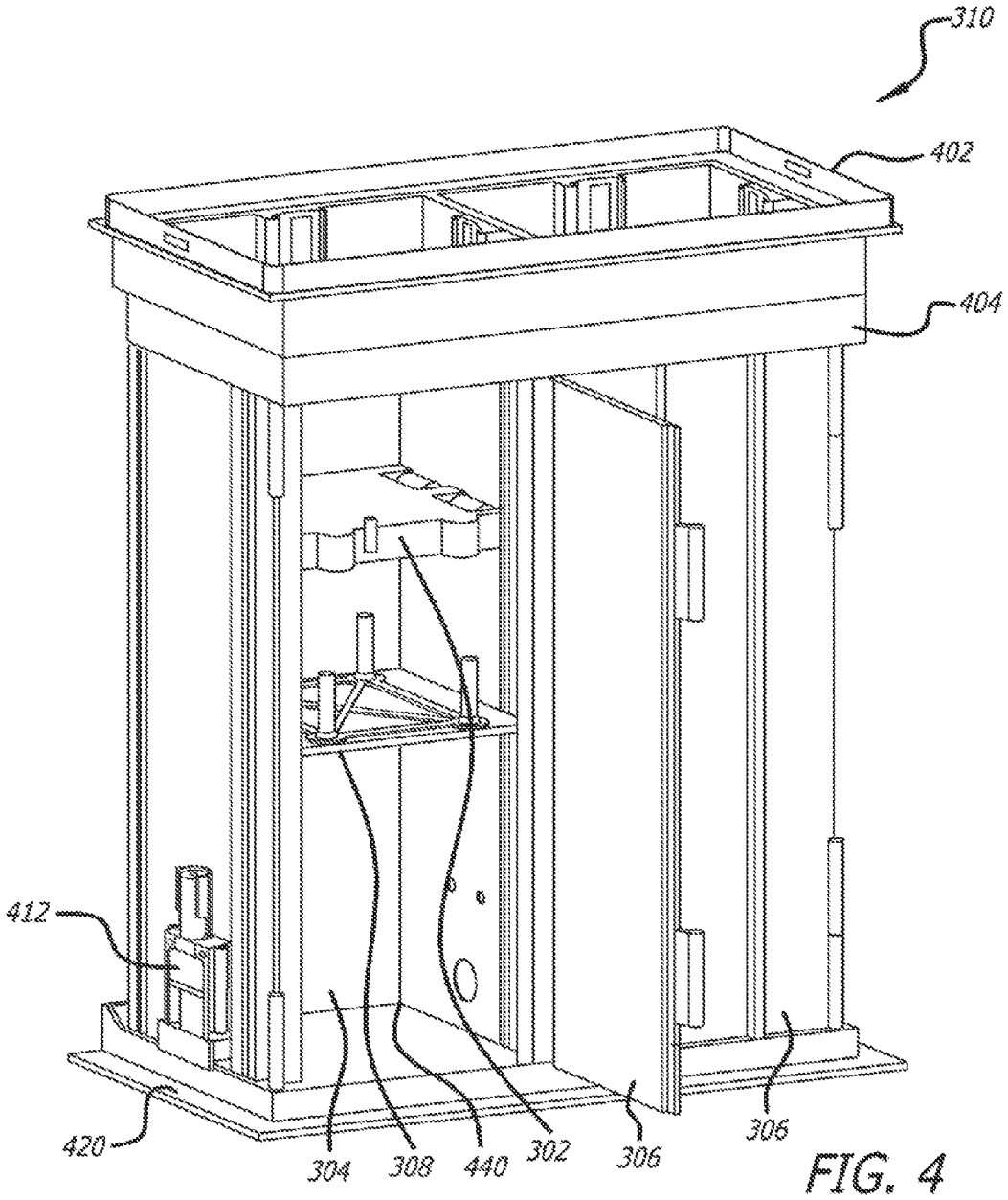
FIG. 4 is a front perspective view of a temperature control and compressor assembly contained in the frozen food dispenser of FIG. 1.
Figure 5:
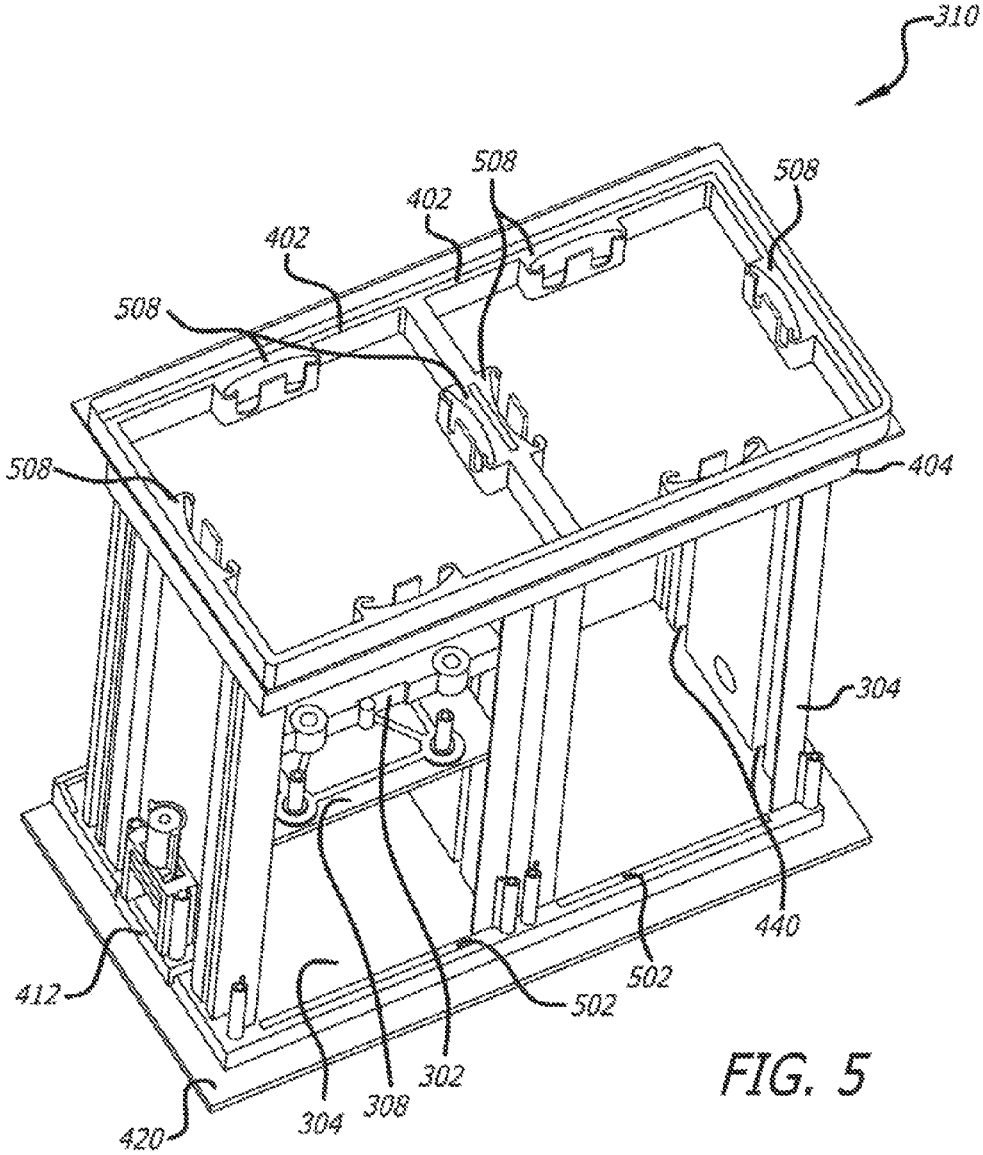
FIG. 5 is a second front perspective view of the temperature control and compressor assembly of FIG. 4.

FIG. 4 illustrates a detailed view of the temperature control and compressor assembly 310 from the frozen food dispenser 100, including a base 420 in which batteries and other electrical components used for the operation of the frozen food dispenser (riot shown) are mounted. The temperature control and compressor assembly 310 also includes a temperature control system 404 mounted below a pair of coolant chambers 402. Referring also to FIG. 5, in an aspect of the operation of the temperature control and compressor assembly, coolant material is placed into the pair of coolant chambers 402. Then, in operation, the temperature control system 404 controls how much coolant is released from each of the pair of coolant chambers 402 into its respective internal chamber of the pair of internal chambers 304 through a plurality of cooling slots 508. The release of the coolant affects (e.g., lowers) the temperature contained in each internal chamber of the pair of internal chambers 304. Each internal chamber of the pair of internal chambers 304 also includes a plurality of exhaust slots 502 so that any coolant that needs to escape can do so. Each internal chamber in the pair of internal chambers 304 also includes a plurality of tracks 440 that are needed in the operation of the elevator assembly 302 to compress the frozen food container 900 in an aspect of the disclosed temperature control and compressor assembly.

Figure 6:
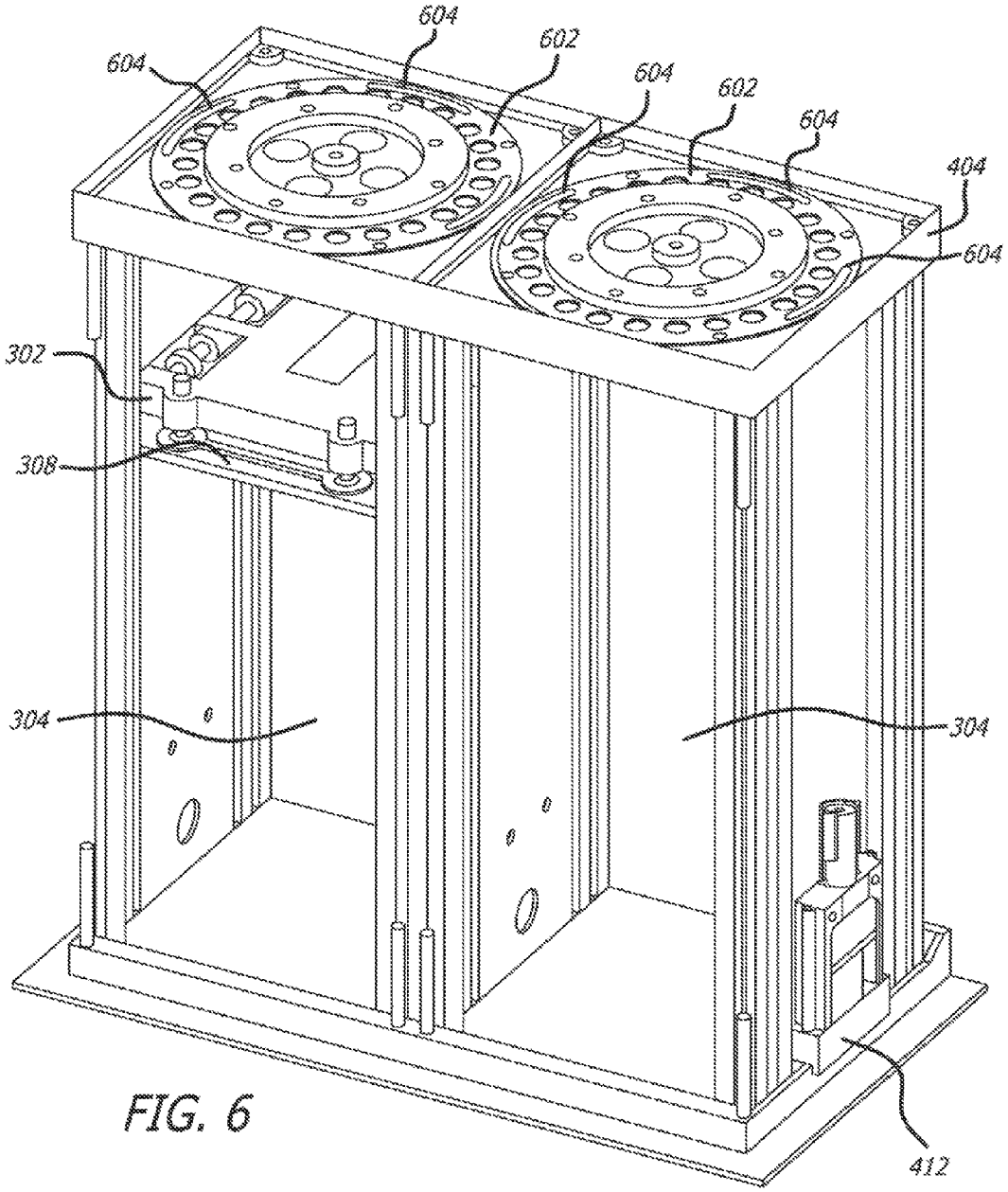
FIG. 6 is a third front perspective view of die temperature control and compressor assembly of FIG. 4 with an exposed temperature control assembly.

FIG. 6 is another perspective view of the temperature control and compressor assembly 310 with an exposed temperature control system 404 configured in accordance with one aspect of the disclosed temperature control system. The temperature control system 404 includes a pair of temperature control disks 602, each configured with a plurality of cooling slots 604 cut therein. The plurality of slots 604 are used in conjunction with the plurality of cooling slots 508 from the coolant chambers 402 and, referring also to FIG. 14, a plurality of cooling slots 1404 located in the tray of the temperature control system 404, to control the amount of coolant that is dispensed into the coolant chambers 402. Specifically, each one of the plurality of cooling slots 1404 are aligned to a respective one of the plurality of cooling slots 508, and, as each of the temperature control disks 602 is rotated, the plurality of cooling slots 604 will be aligned to the plurality of cooling slots 508. Thus, because the plurality of cooling slots 1404 is aligned to the plurality of cooling slots 508, when the plurality of cooling slots 604 is aligned to the plurality of cooling slots 508, the plurality of cooling slots 604 will also be aligned to the plurality of cooling slots 1404. Depending upon the amount of alignment of the plurality of cooling slots 604 to the plurality of cooling slots 508 (and thus the plurality of cooling slots 1404), the amount of coolant released into the coolant chambers 402 can be controlled. Each one of the pair of temperature control disks 602 may be controlled separately. Thus, each disk in the pair of temperature control disks 602 may be controlled to independently affect the temperature of the interior chamber contained below.

Figure 9:
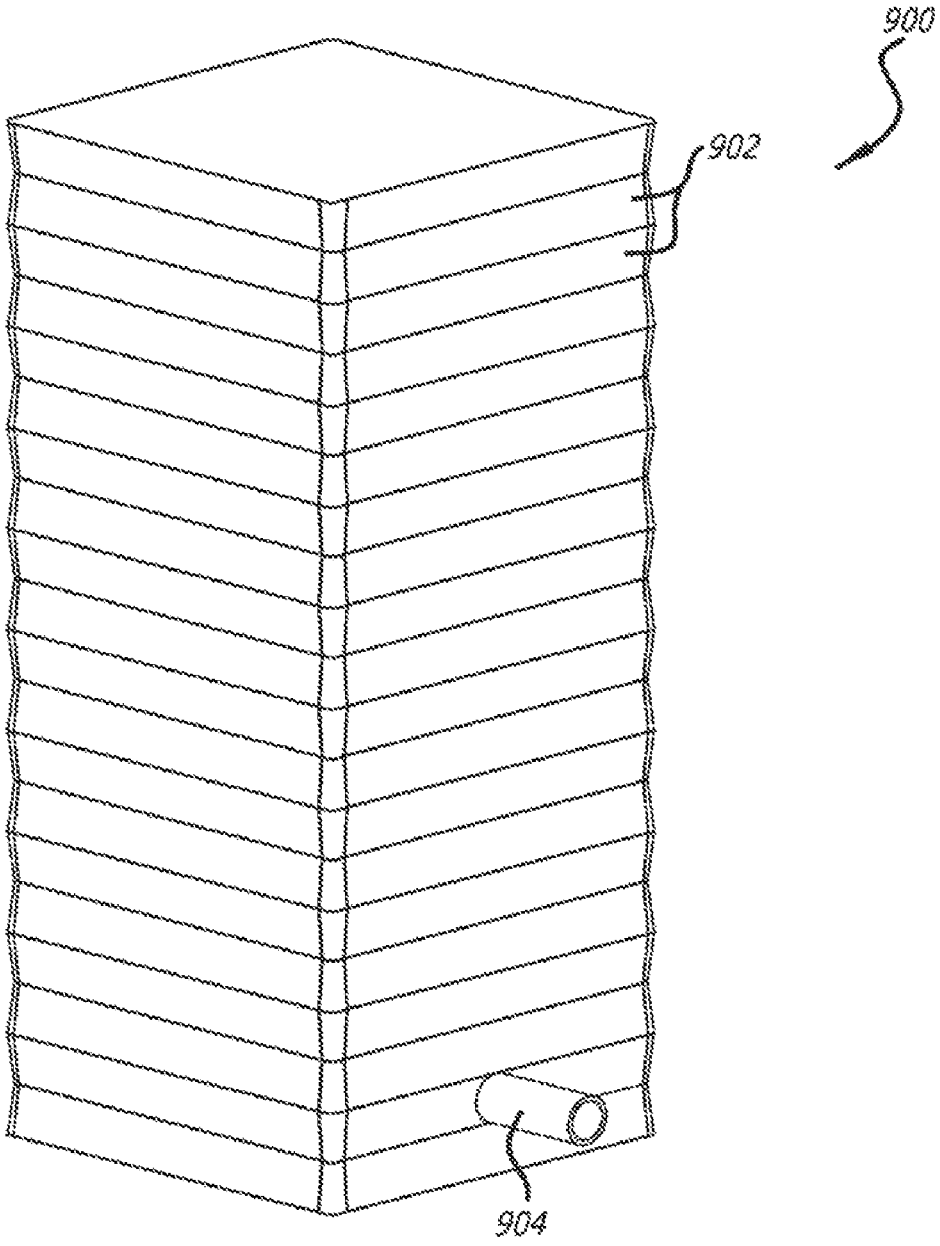
FIG. 9 is a perspective view of a frozen food container.

FIG. 9 illustrates a frozen food container 900 configured in accordance with an aspect of a disclosed frozen food container that may be inserted into each internal chamber of the pair of internal chambers 304. The frozen food container 900 includes a plurality of folds 902 that allows the frozen food container 900 to be compressed in a controlled and predictable manner so that the frozen food contained therein may be dispensed. The frozen food container 900 also includes a dispensing tube 904 through which the frozen food may exit when the frozen food container 900 is compressed. The frozen food container 900 will allow quick and sanitary replacement of the frozen food.

Figure 7:
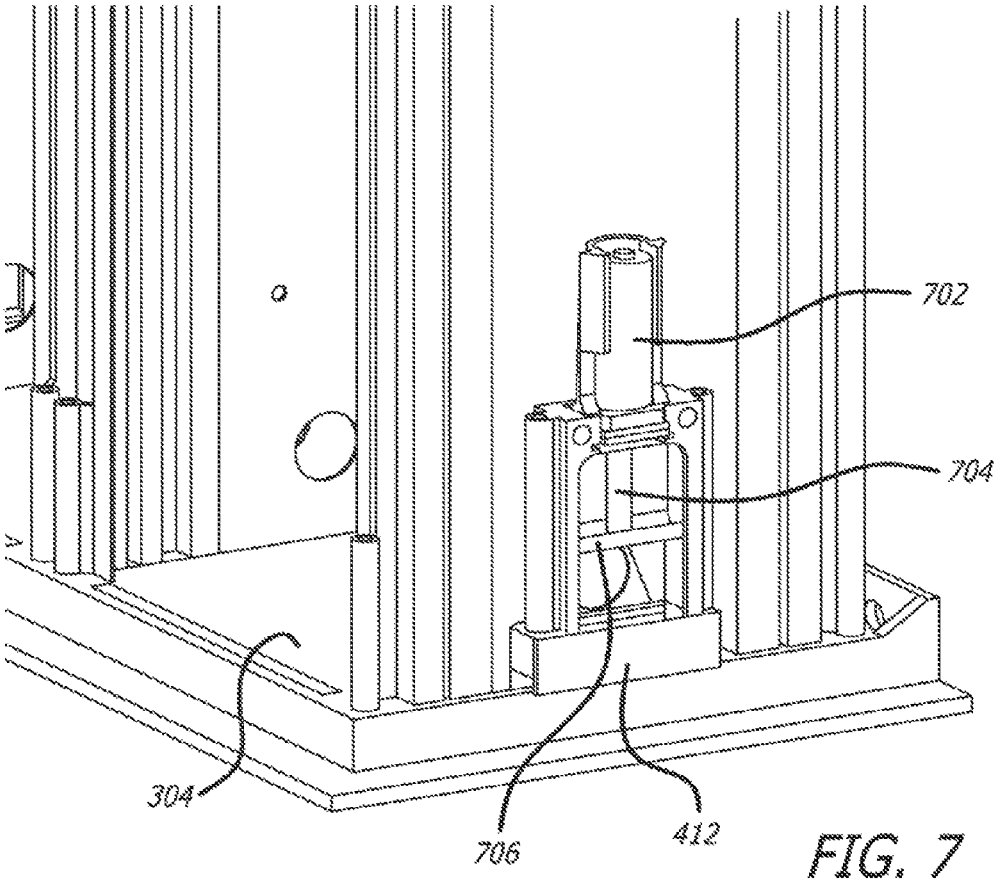
FIG. 7 is a perspective view of a shut-off valve of the frozen food dispenser of FIG. 1.

Referring back to FIG. 4, and further referring to FIGS. 5-7, a perspective view of a shut-off valve 412 of the frozen food dispenser 100 configured in accordance with one aspect of die disclosed shut-off valve is shown. The shut-off valve 412 includes a motor 702 that drives a threaded shaft 704 to close a clamp 706 to control the dispensing of the contents of the frozen food container 900. In an aspect of a disclosed value, clamp 706 is configured to close down upon dispensing tube 904 to limit what is being dispensed from frozen food container 900 and is used in conjunction with elevator assembly 302 and a pressure plate 308 to control the dispensing of the frozen food contained in the frozen food container 900, as further detailed herein.

Figure 10:
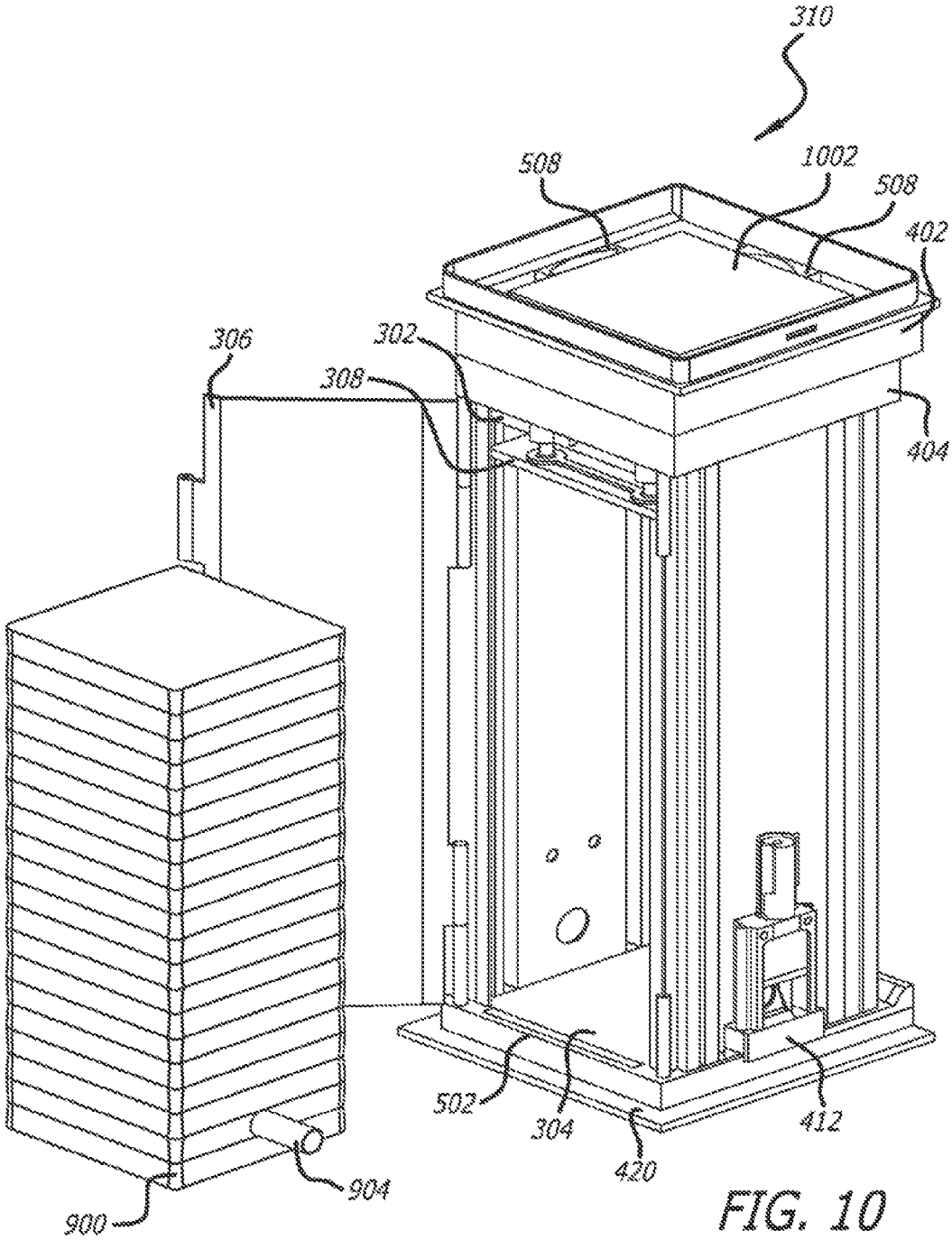
FIG. 10 is a perspective view of the frozen food container of FIG. 9 in the process of being inserted into an internal chamber the temperature control and compressor assembly of FIG. 4.

FIG. 10 is a perspective view of the frozen food container 900 about to be inserted into one of the internal chambers 304 of the temperature control and compressor assembly 310. To simplify the description, only one-half of the temperature control and compressor assembly 310 will be described. In an aspect of the disclosed operation of the frozen food dispenser, the frozen food container 900 is inserted into one of the pairs of internal chambers 304 in the frozen food dispenser 100, with the dispensing tube 904 of die frozen food container 900 being inserted through the opening of the shut-off valve 412 associated with that internal chamber.

Figure 11:
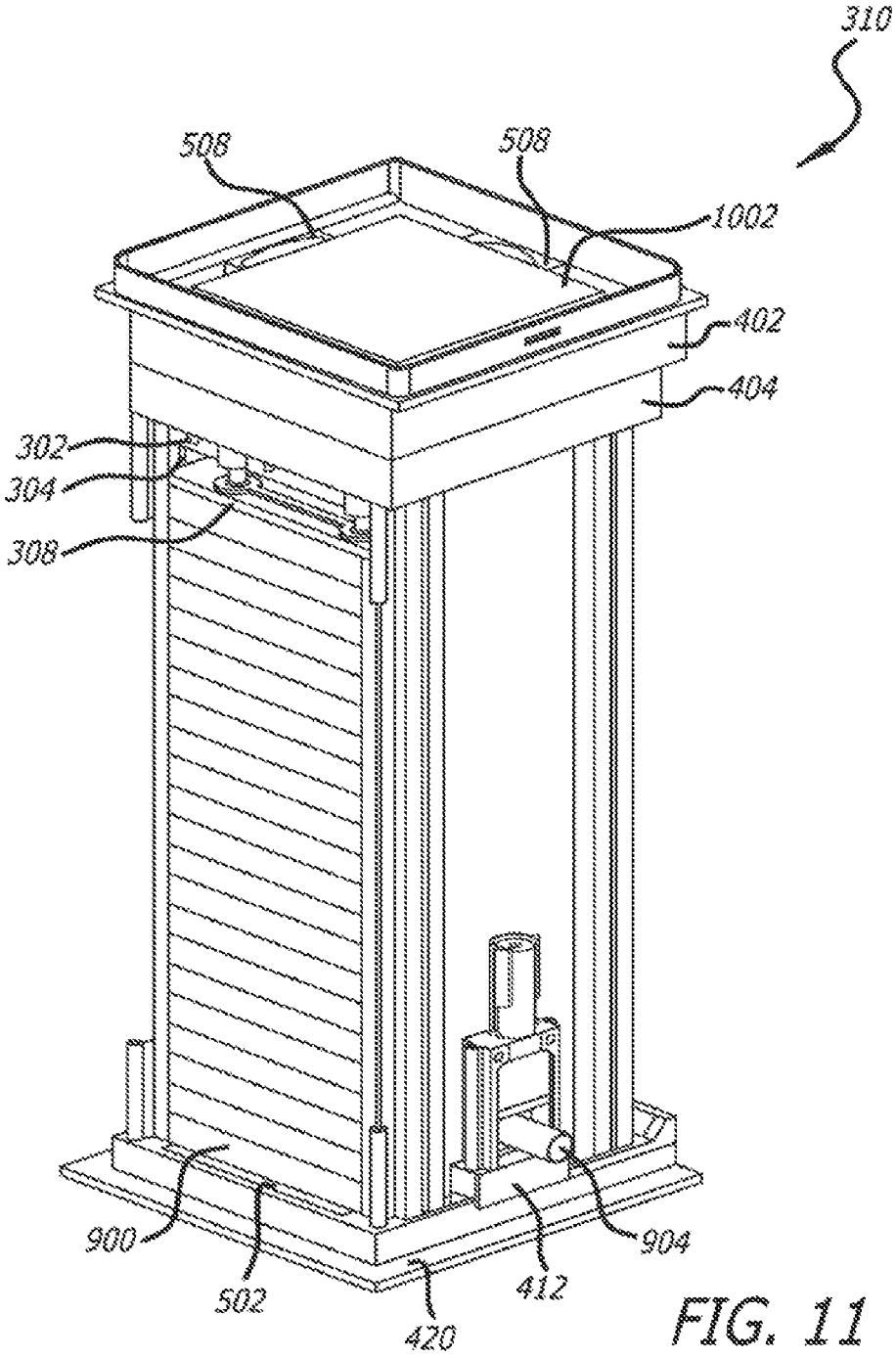
FIG. 11 is a perspective view of the frozen food container of FIG. 9 inserted into the internal chamber of the temperature control arid compressor assembly of FIG. 4.
Figure 12:
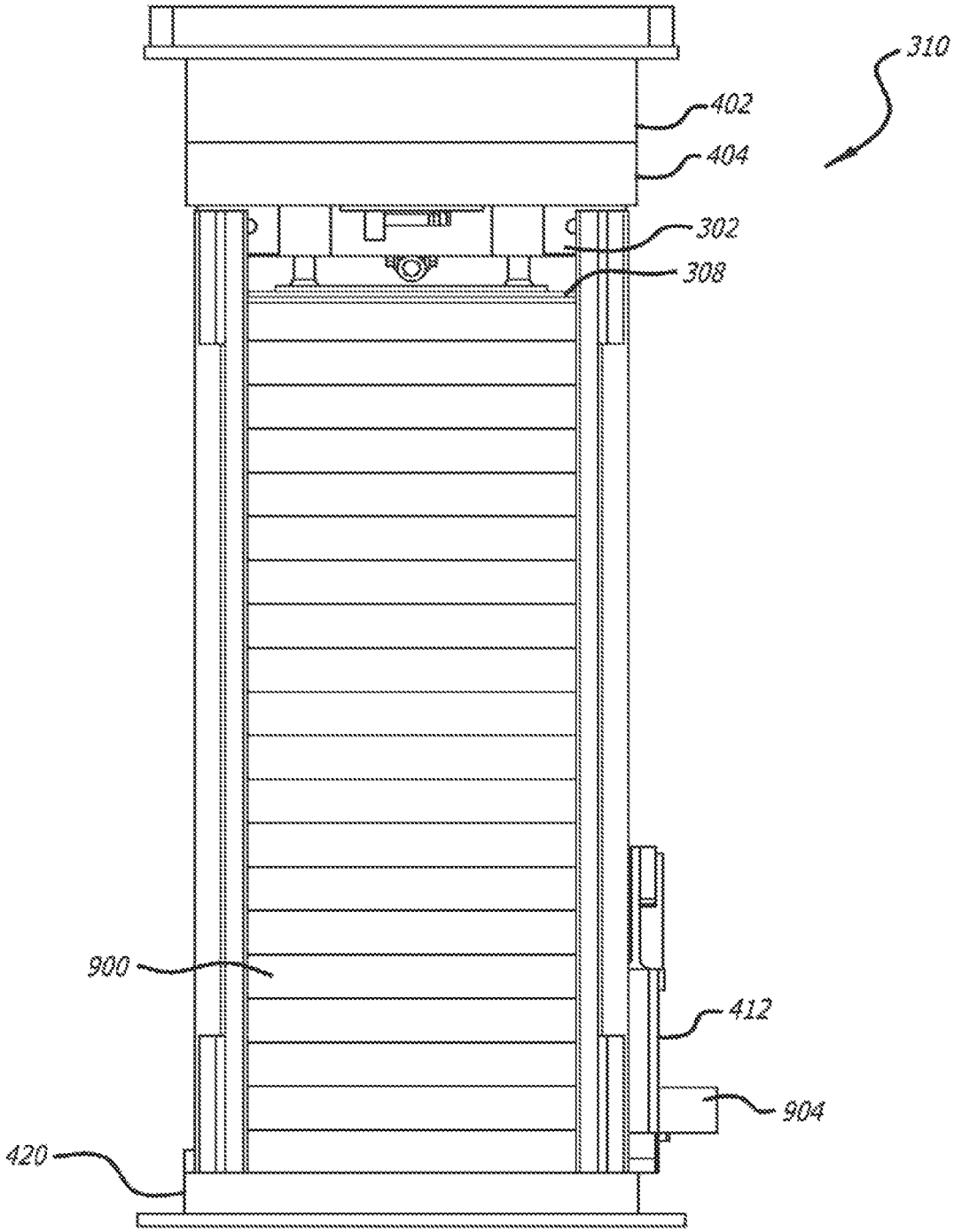
FIG. 12 is a front plan view of the frozen food container of FIG. 9 inserted into the internal chamber of the temperature control and compressor assembly of FIG. 4.

FIGS. 11 and 12 illustrate perspective and side plan views, respectively, of the frozen food container 900 after it has been inserted into one of the pairs of internal chambers 304 of the temperature control and compressor assembly 310. In an aspect of the disclosed operation of the frozen food dispenser, after the frozen food container 900 has been loaded, the shut-off valve 412 can clamp the dispensing tube 904. Then, the elevator assembly 302 will be lowered to be snug with the frozen food dispenser 900. In another disclosed operation of the frozen food dispenser, elevator assembly 302 will be used to prime the frozen food to be dispensed so the frozen food container 900 will be squeezed until a predetermined amount of the frozen food contained in the frozen food container 900 is dispensed from the dispensing tube 904 and then the shut-off valve 412 will be closed.

As previously discussed, when the elevator assembly 302 is driven up or down, the pressure plate 308 is also moved up or down. When the pressure plate 308 is moved down, the frozen food container 900 is compressed by the pressure plate 308 to dispense the contents of the frozen food container 900. As discussed above, the dispensing of the contents of the frozen food container 900 through the dispensing tube 904 is also regulated by the shut-off valve 412. The shut-off value 412 may be used to regulate the maximum amount of frozen food that is dispensed from the frozen food container 900 while the elevator assembly 302 and the pressure plate 308 may be used to generate a desired positive pressure applied to the frozen food container 900. In addition, the elevator assembly 302 and the pressure plate 308 may be used to generate a desired negative pressure as applied to the frozen food container 900 before the shut-off valve 412 is operated to stop the dispensing the frozen food. Specifically, when the elevator assembly 302 (and thereby the pressure plate 308) is moved upwards, the frozen food container 900 will be allowed to expand (or will be forced to expand like an accordian if the frozen food container 900 is attached to the pressure plate 308). In this case, the contents of the frozen food container 900 will be pulled back in through the dispensing tube 904. Thus, the elevator assembly 302 is operated in conjunction with the shut-off valve 412 so that the dispensing of the contents of the frozen food container 900 can be regulated.

Figure 13:
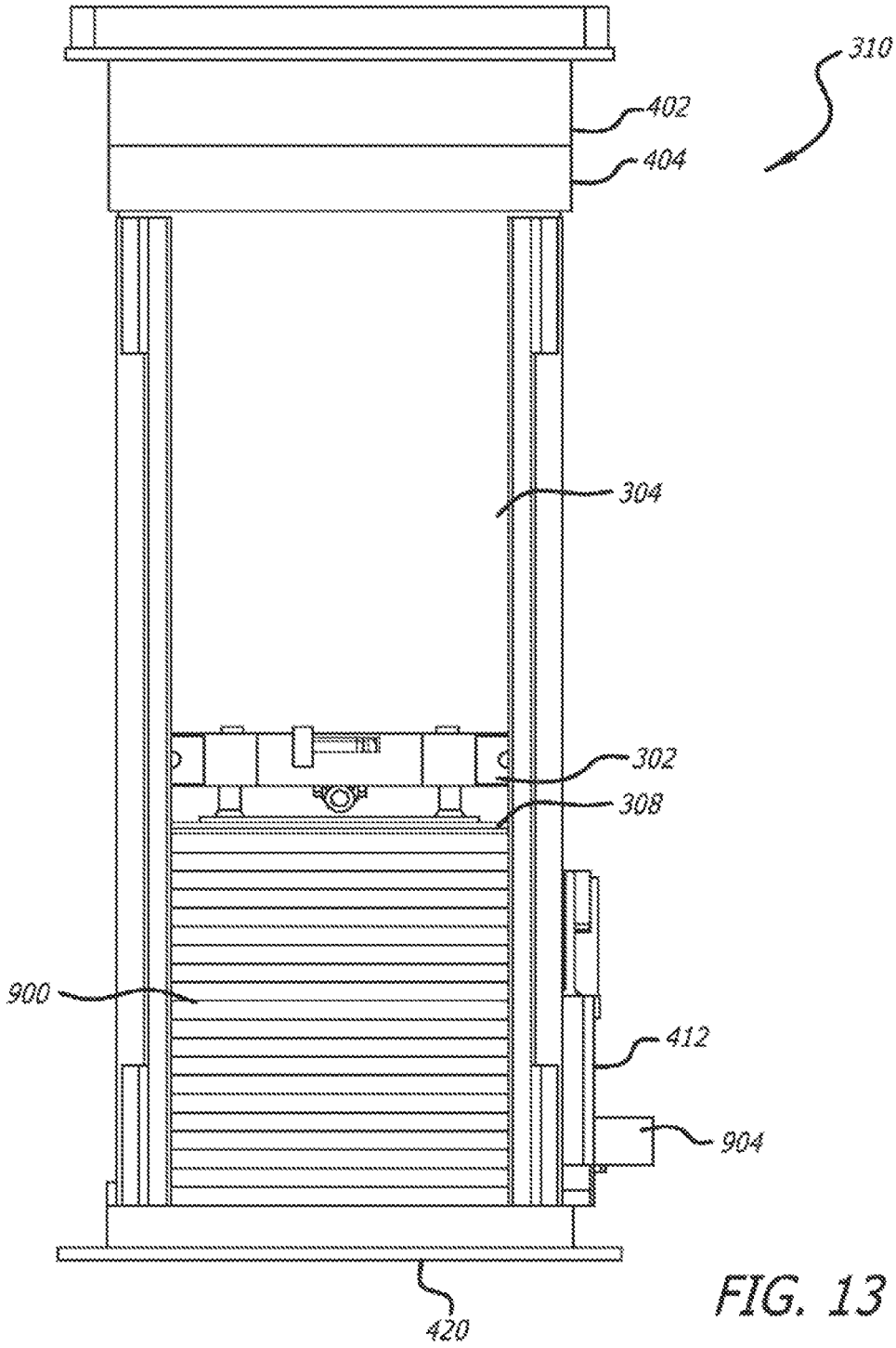
FIG. 13 is a front plan view of the frozen food container of FIG. 9 inserted into the internal chamber of the temperature control and compressor assembly of FIG. 4, wherein a portion of the contents of the frozen food container has been dispensed in accordance with one preferred embodiment Of the present invention.

FIG. 13 is a front plan view of the frozen food container 900 that was previously inserted into the temperature control and compressor assembly 310, wherein a portion of the contents of the frozen food container 900 has been dispensed in accordance with an aspect of the operation of the frozen food container.

Figure 14:
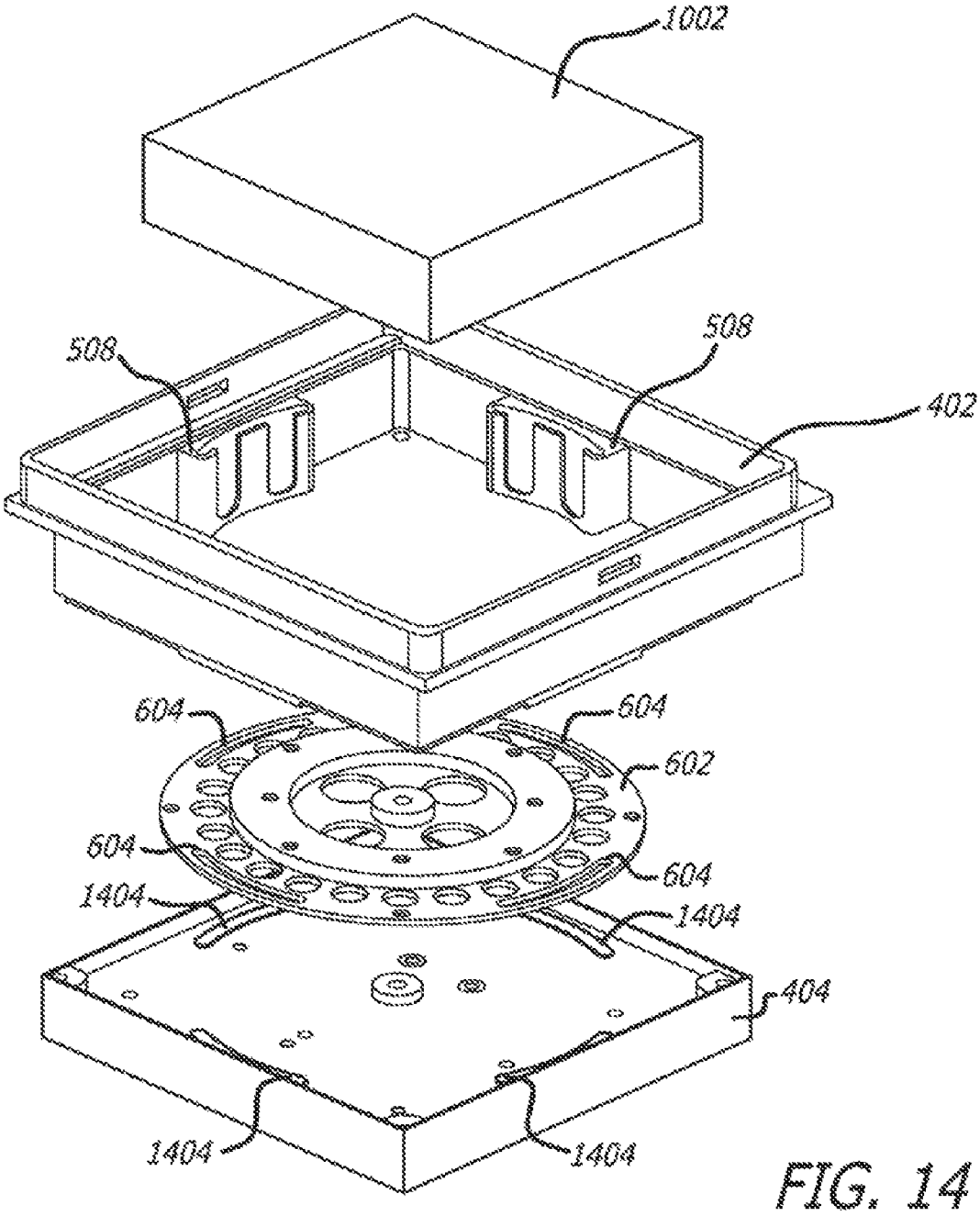
FIG. 14 is a front exploded perspective view of the temperature control assembly of FIG. 6.
Figure 17:
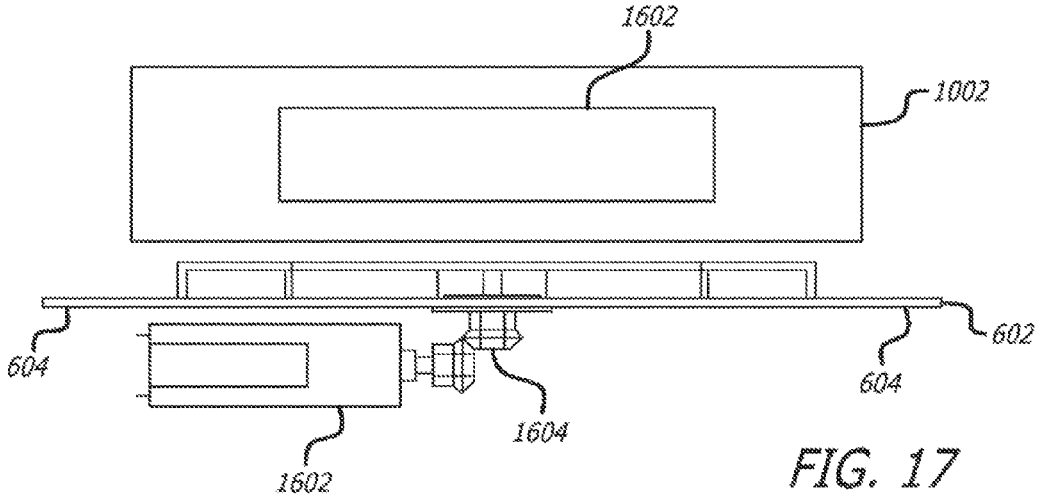
Figure 18:
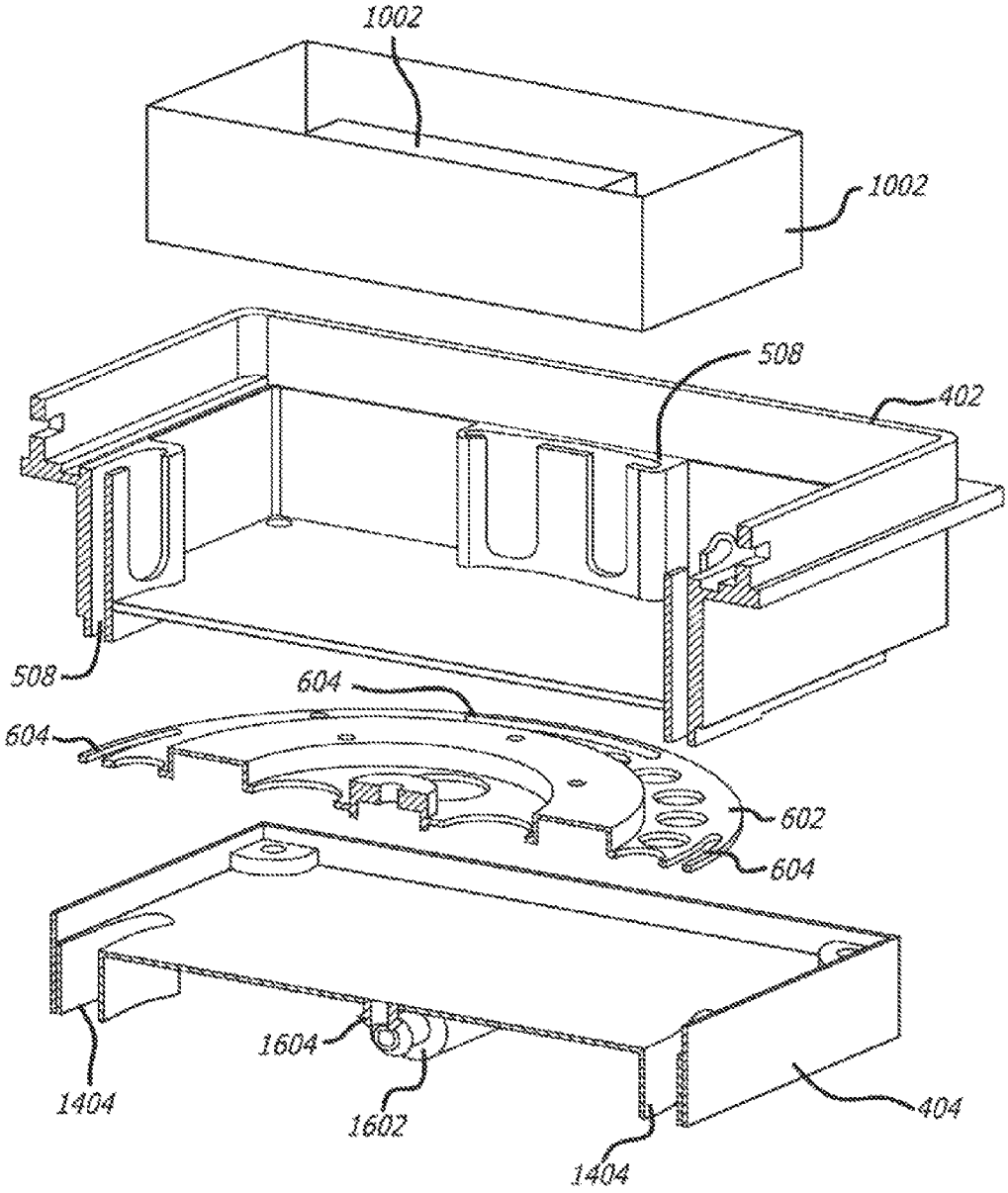
FIG. 18 is an exploded cross-sectional view of the temperature control assembly, temperature control disk and coolant chamber of FIG. 14.

FIG. 14 is a front exploded perspective view of the temperature control assembly 404, which will be described with reference to FIGS. 10-13 and 15-18. In an aspect of the disclosed temperature control assembly, the temperature control assembly 404 includes a cooling pack 1002 that is stored in the coolant chamber 402. In an aspect of the disclosed cooling pack, as shown in FIG. 18, cooling pack 1002 is filled with water. Cooling pack 1002 also includes a dry ice portion 1602. The cooling pack 1002 is inserted into the interior of the coolant chamber 402. As the air around the cooling pack 1002 is cooled, the cooled air goes down the plurality of cooling slots 508, passes through the portion of the plurality of cooling slots 604 of the temperature control disk 602 that is aligned with the plurality of cooling slots 508 and the plurality of cooling slots 1404 in the tray of the temperature control system 404 into the interior of the coolant chamber 402.

Figure 15:
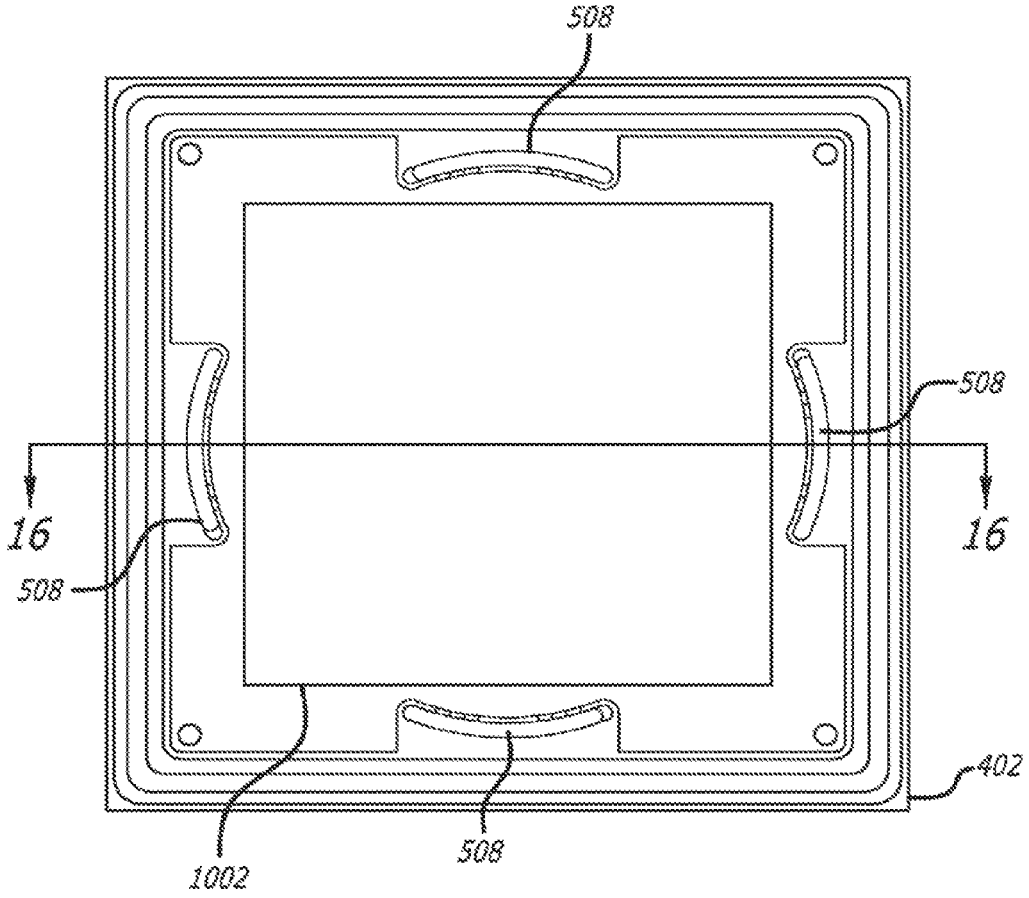
FIG. 15 is a top plan view of the temperature control assembly of FIG. 6.
Figure 16:
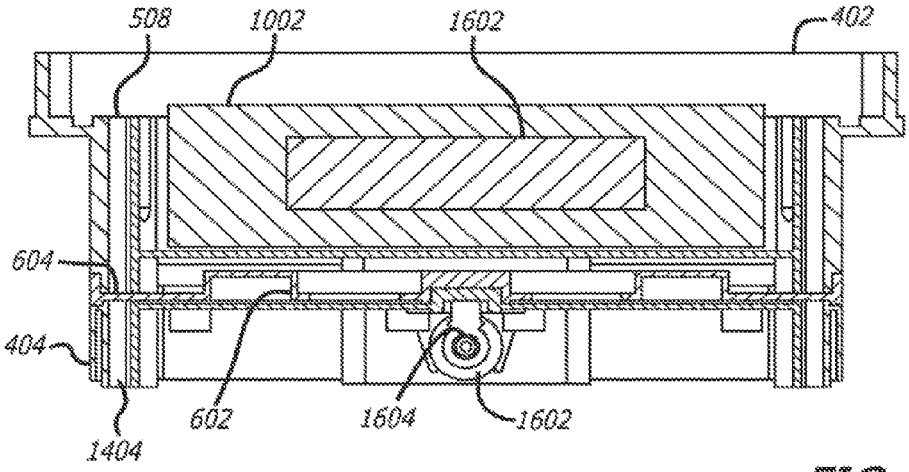
FIG. 16 is a cross-sectional view of the temperature control assembly of FIG. 6, taken along line XVI-XVI as illustrated in FIG. 15; and, FIG. 17 is an exploded cross-sectional view of the temperature control assembly of FIG. 6.

FIG. 16 is a cross-sectional view of the temperature control assembly 404, taken along line XVI-XVI of the top plan view illustrated in FIG. 15. In addition, FIG. 17 is a cross-sectional view of selected components from control assembly 404, with FIG. 18 being an exploded cross-sectional view of the temperature control assembly 404. As shown in these figures, the temperature control disk 602 is rotated by a motor 1602 coupled to a set of gears 1604. The alignment of the temperature control disk 602 controls the cooling from the coolant cooled air into the internal chambers 304 of the frozen food dispenser 100. Specifically, the plurality of cooling slots 604 of the temperature control disk 602 arc aligned with the plurality of cooling slots 508 from the coolant chambers 402 and the plurality of cooling slots 1404 located in the tray of the temperature control system 404 to control the cooling provided to the items in the internal chamber 304. It should be noted that, in an aspect of the disclosed configuration of the frozen food dispenser, it is assumed that the position of the coolant (e.g., cooling pack 1002) is located with respect to the frozen food dispenser 100 so that the air being cooled, which becomes more dense, is pulled by gravity over the product, to be cooled.

As described above, one frozen food that may be dispensed from the frozen food dispenser 100 is ice cream. In other aspects of the disclosed frozen food dispenser, the items being cooled may be such items as liquids (e.g., alcoholic and non-alcoholic beverages); semi-frozen liquids (e.g., "slushies"); or any item that needs to be copied or maintained around a particular temperature. For example, the portable temperature controlled container described herein may be used to cool non-food items, such as biological materials (e.g., human organs) or chemicals that need to be maintained at a predetermined temperature. Further, the configuration of the portable temperature controlled container may be altered to suit the contents being carried, including a form that resembles a shape similar to beverage coolers. In addition, the portable cooling system may have other dispensing mechanisms built into it to dispense frozen, liquid or semi-frozen liquid beverages, mixed or non-mixed. For example, a standard interior size may be created so that custom modules that perform various functions (mixing, cooling, heating) can made interchangeable. Thus, each portable temperature/controlled container can be customized for a particular application simply by the selection of an appropriate module.

Further still, in another aspect of the disclosed portable temperature controlled container, a heated container may be used to store items that need to be maintained at a temperature that is higher than the ambient temperature. In this case, the temperature control (i.e., heating) unit may be located on the bottom of the internal chamber of a temperature control and compression assembly to take advantage of the physical property that heal rises. In effect, the disclosed temperature control and compressor assembly may be reoriented upside down. Thus, the amount of heat that is provided to the internal chamber is based on the size of the opening in the temperature control unit that will allow the heat from the temperature control unit to rise into the internal chamber. Any suitable heat source may be used, including chemical or electrically-based solutions.

The previous description of the disclosed aspects is provided to enable any person skilled in the art to make or use the present disclosure. Various modifications to these aspects will be readily apparent to those skilled in the art, and the generic principles defined herein may be applied to other aspects without departing from the scope of the present disclosure. Thus, the present disclosure is not intended lb be limited to the aspects shown herein but is to be accorded the widest scope consistent with the principles and novel features disclosed herein. Accordingly, the present invention is to be defined solely by the scope of the following claims.

What is claimed is:

1. A portable temperature controlled container comprising:

a body having an internal chamber with an opening into the internal chamber, wherein the body further comprising a dispensing opening defined therein in communication with the internal chamber;

a temperature control unit coupled to the body and displaced to be thermally coupled with a first portion of the internal chamber, the temperature control unit configured to selectively alter the temperature in the internal chamber by releasing a thermally controlled material into the internal chamber;

a removable food container configured to fit into the internal chamber of the body and having a dispensing portion that is insertable through the dispensing opening;

a compressor in the internal chamber configured to selectively compress the removable food container; and a valve coupled to the dispensing portion of the removable food container and configured to, in coordination with the compressor, control an amount of content that is dispensed from the dispensing portion of the removable food container.

2. The portable temperature controlled container of claim 1, wherein the body is removably displaced within a space of the portable temperature controlled container.

3. The portable temperature controlled container of claim 1, wherein the temperature control unit comprises an enclosure having a first surface that is thermally coupled to the first portion of the internal chamber of the body, the first surface having a plurality of adjustable openings contained therein.

4. The portable temperature controlled container of claim 3, wherein the plurality of adjustable openings of the first surface of the temperature control unit comprises a plurality of openings, and the temperature control unit further comprises a movable plate having a plurality of openings matched to the plurality of openings of the first surface of the temperature control unit with the plurality of adjustable openings being defined by an alignment of the plurality of openings of the first surface and the plurality of openings of the movable plate.

5. The portable temperature controlled container of claim 3, wherein the body has a top portion and the first portion of the internal chamber of the body is displaced at the top portion.

6. The portable temperature controlled container of claim 3, further comprising a coolant pack contained in the enclosure of the temperature control unit.

7. The portable temperature controlled container of claim 6, wherein the coolant pack comprises:

a first material having a first predetermined freezing temperature; and a second material with a second predetermined freezing temperature thermally coupled to the first material.

8. The portable temperature controlled container of claim 3, wherein the body has a bottom portion and the first portion of the internal chamber of the body is displaced at the bottom portion.

9. The portable temperature controlled container of claim 3, further comprising a heating pack contained in the enclosure of the temperature control unit.

10. The portable temperature controlled container of claim 1, wherein the internal chamber has a volume, wherein the compressor is further configured to change the volume of the internal chamber.

11. The portable temperature controlled container of claim 10, wherein the compressor comprises:

a pressure plate; and, an elevator assembly coupled to move the pressure plate in the internal chamber.

* * * * *